US006012931A

United States Patent [19]

Michaux et al.

[11] Patent Number: 6,012,931

[45] Date of Patent: Jan. 11, 2000

[54] CONNECTOR HAVING SURFACE MOUNT TERMINALS FOR CONNECTING TO A PRINTED CIRCUIT BOARD

[75] Inventors: Gwen L. Michaux, DuBois; David C. Horchler, Millersburg, both of Pa.

[73] Assignee: Berg Technology, Inc., Reno, Nev.

[21] Appl. No.: 09/109,514

[22] Filed: Jul. 2, 1998

[51] Int. Cl.[7] ..... H01R 9/09

[52] U.S. Cl. ..... 439/79

[58] Field of Search ..... 439/79, 80, 381, 439/108, 607

[56] References Cited

U.S. PATENT DOCUMENTS

| | | | |
|---|---|---|---|
| 4,533,203 | 8/1985 | Feldman et al. . | |
| 4,659,156 | 4/1987 | Johnescu et al. . | |
| 4,741,703 | 5/1988 | Johnescu et al. | 439/63 |
| 4,846,719 | 7/1989 | Iwashita | 439/63 |
| 5,011,415 | 4/1991 | Suzuki et al. | 439/63 |
| 5,046,952 | 9/1991 | Cohen et al. | 439/63 |
| 5,346,404 | 9/1994 | Shimada | 439/79 |
| 5,423,696 | 6/1995 | Sato | 439/607 |
| 5,478,258 | 12/1995 | Wang | 439/581 |
| 5,492,842 | 2/1996 | Eytcheson et al. | 437/7 |
| 5,575,663 | 11/1996 | Broschard , III et al. | 439/79 |
| 5,586,008 | 12/1996 | Kozel et al. | 361/743 |
| 5,645,454 | 7/1997 | Kosmala | 439/675 |

FOREIGN PATENT DOCUMENTS

WO 87/00978 2/1987 WIPO .

*Primary Examiner*—Steven L. Stephan
*Assistant Examiner*—Jean Duverne
*Attorney, Agent, or Firm*—Brian J. Hamilla; Daniel J. Long; M. Richard Page

[57] ABSTRACT

A connector having a set of terminals (10) that are preferably coplanar and are used to connect electrical components, such as surface mount components, with a printed circuit board (PCB). The connector uses an insulative wafer (50) to achieve and to maintain the coplanarity of the terminals (10). Initially, the terminals (10) are overbent so that as the wafer (50) is being placed in the connector housing (5), the terminals (10) contact the wafer (50) on a slope (55) of the wafer (50). In other words, as the wafer (50) is being mated with the connector housing (5), the wafer (50) pushes against the terminals (10) to establish coplanarity. Thus, the wafer (50) works in conjunction with the terminals (10) in the connector housing (5) to establish coplanarity. Therefore, the connector supports the terminals (10) for positioning while ensuring that the terminals (10) are coplanar.

22 Claims, 3 Drawing Sheets

ANGLE B + X
10
15
50
5

ANGLE B
10
20
55
15
50
5

ANGLE B
10
20
26
25
15
14
7
5
55
ANGLE Y
50

ANGLE B
10
30
55
ANGLE Y
60
50
5

ANGLE B
10
30
50
5

ANGLE B + X
10
30
50
5

CONNECTOR HAVING SURFACE MOUNT TERMINALS FOR CONNECTING TO A PRINTED CIRCUIT BOARD

FIELD OF THE INVENTION

The present invention relates in general to a connector for printed circuit boards. More particularly, the present invention relates to terminals of a connector for connecting a surface mount component to a printed circuit board prior to soldering of the component to form an assembly.

BACKGROUND OF THE INVENTION

Electrical connectors for mounting to circuit boards typically have contact leads or terminals that extend through plated through holes or have leads or terminals that engage contact pads on the surface of the circuit board. After positioning and securing the connector with respect to the circuit board, the terminals are soldered to the circuit board. Precise coplanarity is essential in surface mount connectors. It is important that the terminals of a connector are coplanar and within the proximity of the solder pads on the surface of the circuit board so that the terminal leads will become soldered to the circuitry of the printed circuit board. If the terminals are not coplanar to each other within a small range, typically about 0.10 mm (0.004 inches), the lowest positioned terminals will sit on the top surface of the circuit pad where they will be securely soldered, while the highest positioned terminals (greater than about 0.10 mm) will be so far from the pads that they will not be encompassed by the thickness of solder paste, and will not become securely soldered. In other words, if the terminals are not coplanar, some terminals will contact the board, and some will not, thereby leading to open contact failures.

In the prior art, in the construction process of the connector, the terminals are bent and/or positioned with mechanical tooling so that they desirably match up with the surface of the printed circuit board. Clearance is designed at the back and the front of the terminal, and there is no intention of influencing the position of the terminal in those directions after the terminal has been bent and placed in a connector housing. Each terminal is bent and/or positioned so that it, desirably, is coplanar with the other terminals. However, normal component and process variations make attaining exact or near exact (e.g., within about 0.10 mm) bent terminal lead positioning (i.e., coplanarity) very difficult. Attaining this very small amount of variance is complex and expensive. Moreover, because the bending and/or positioning of the terminals has such a narrow tolerance in order to achieve coplanarity, the rate of failure is high.

Although the art of connectors having terminals and leads is well developed, there remain some problems inherent in this technology, particularly with respect to coplanarity of the terminals in the connector. Therefore, a need exists for a connector having terminals that overcomes the drawbacks of the prior art.

SUMMARY OF THE INVENTION

The present invention is directed to an electrical connector assembly for mounting on a printed circuit board, comprising: a housing having a plurality of passages; a plurality of terminals, each terminal having a first end disposed in an associated one of the plurality of passages and bent at an initial angle; a body, and a second end arranged to engage an associated contact pad on the printed circuit board; and a wafer having a sloped end at an angle, the sloped end contacting the body of each of the plurality of terminals so that the first end of each of the plurality of terminals is bent to a predetermined angle, whereby each of the plurality of terminals is coplanar.

According to one aspect of the present invention, the predetermined angle is responsive to the angle of the sloped end of the wafer.

In accordance with another aspect of the present invention, the predetermined angle is substantially equal to the angle of the sloped end of the wafer.

In accordance with a further aspect of the present invention, the angle of the sloped end of the wafer has a value in the range between about 6 and about 45 degrees, and preferably about 15 degrees.

In accordance with further aspects of the present invention, the body of each terminal is substantially linear, and the wafer comprises an insulating material.

In accordance with a further aspect of the present invention, the initial angle of the first end is not greater than the angle of the sloped end of each wafer. The initial angle has a value in the range between about 5 and about 25 degrees, and preferably about 10 degrees.

In a further embodiment within the scope of the present invention, an electrical connector assembly for mounting on a printed circuit board comprises a housing having a plurality of passages, a plurality of first terminals, a plurality of second terminals, and a wafer. Each first terminal has a first end disposed in an associated one of the plurality of passages and bent at an initial angle, a body, and a second end arranged to engage an associated contact pad on the printed circuit board. Each second terminal has a first end disposed in an associated one of the passages and bent at approximately a right angle, and a body having a second end arranged to engage an associated contact on the printed circuit board. The wafer has a sloped end at an angle, the sloped end contacting the body of each of the first terminals so that the first end of each of the first terminals is bent to a predetermined angle, whereby each of the first terminals is coplanar. The wafer also has apertures with each aperture corresponding to an associated one of the second terminals so that the body of the associated one of the second terminals passes through the aperture.

The foregoing and other aspects of the present invention will become apparent from the following detailed description of the invention when considered in conjunction with the accompanying drawing.

DESCRIPTION OF EXEMPLARY EMBODIMENTS AND BEST MODE

The present invention is directed to a connector having a set of terminals. The terminals are preferably coplanar and are used as part of an electrical path connecting a mating connector with a printed circuit board (PCB). The connector in accordance with the present invention uses an insulative wafer to achieve and maintain the coplanarity of the terminals. Initially, the terminals are overbent so that as the wafer is being placed in the connector housing, the terminals contact the wafer on a slope of the wafer. In other words, as the wafer is being mated with the connector housing, the wafer pushes against the terminals to establish coplanarity. Thus, the wafer works in conjunction with the terminals in the connector housing to establish coplanarity. Therefore, the connector supports the terminals for positioning while ensuring that the terminals are coplanar.

Figures 1A, 1B, 1C:
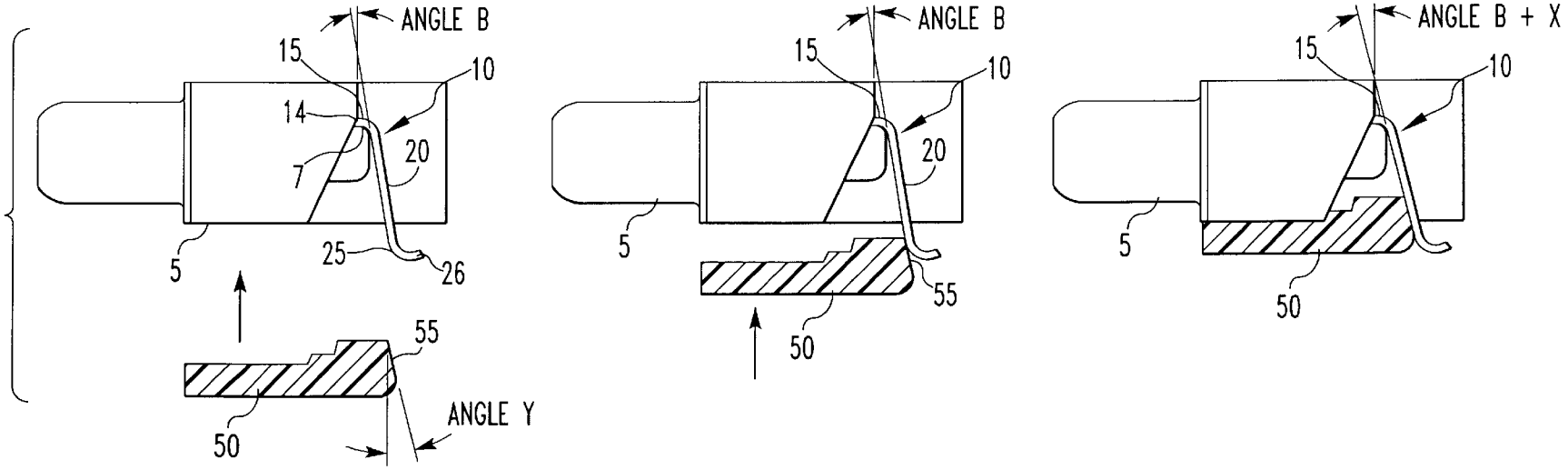
FIG. 1A is a cut-away side view of an exemplary connector housing having a terminal in accordance with the present invention prior to mating with a wafer.
FIG. 1B is a cut-away side view of the exemplary connector housing of FIG. 1A as it is being mated with the wafer.
FIG. 1C is a cut-away side view of the exemplary connector housing of FIG. 1A after being mated with the wafer.

FIG. 1A is a cut-away side view of an exemplary connector housing having a terminal in accordance with the present invention prior to mating with a wafer. The housing 5 can be a conventional housing and preferably comprises plastic or other dielectric material in which a plurality of terminals can be placed and electrically insulated from each other.

Each terminal 10 comprises a first bend 15, disposed at an end 14 of a mating portion a substantially linear body 20, and a second bend or heel 25, disposed at an end 26 of a mounting portion. Each terminal 10 is inserted into an associated passage in the connector housing 5, as would be known to those skilled in the art, and is preferably bent using conventional mechanical tooling, although any method of providing the two bends 15, 25 in the terminal 10 can be used. The first bend 15 is wrapped around an anvil portion 7 of the housing 5 that defines the passage into which the terminal is inserted, and has an angle B, prior to mating with the wafer 50. The angle B is preferably in the range between about 5 and about 25 degrees, and more preferably about 10 degrees, as measured between vertical as shown in FIG. 1A and the body 20 of the terminal 10. The second bend or heel 25 is at the lead or solder tail end 26 of the terminal 10 and is used as a contact for the PCB to which the connector is ultimately mounted. The second bend 25 preferably has an angle in the range between about 45 and about 135 degrees, and more preferably has an angle in the range between about 90 and about 110 degrees, as measured with respect to the body 20 of the terminal 10.

A wafer 50 is used to establish and maintain coplanarity of the terminals 10. The wafer 50 preferably comprises an insulative material to insulate neighboring terminals from each other. After the terminal 10 has been inserted into the housing 5 and appropriately bent, the wafer 50 is positioned for mounting in the housing 5, as shown in FIG. 1B. One end of the wafer 50 preferably has a slope 55. The slope 55 is used to force the terminals 20 into a new angle, coplanar with one another. The angle of the slope 55 is preferably in the range between about 6 and about 45 degrees, and more preferably is about 15 degrees, although any angle can be used to force the terminals 20 into a new angle, coplanar with one another. After positioning the wafer 50 with respect to the housing 5, the wafer 50 is pressed into connection with the rest of the connector assembly, as shown in FIG. 1C. Preferably, the wafer 50 snaps into preformed grooves on the connector housing 5 for a secure fit. It should be noted that any conventional means of securing the wafer 50 to the housing 5 can be used.

By connecting the wafer 50 with the rest of the connector assembly, as shown in FIG. 1C, each terminal 10 is forced out to a new angle, by the slope 55 of the wafer 50. For example, after bending the terminal legs 20 around the anvil portion 7, the location of the heels 25 of the terminal legs have more variation from terminal to terminal than what would be acceptable for a surface mount soldering process because of variations in the components 7, 10, 15, and variations in the bending operation. Engagement of the terminal legs 20 with the slope 55 of the wafer 50 forces the angle B of the terminals 20 to change, thereby moving the heels 25 of the terminals into better coplanarity, with each other.

In accordance with the present invention, the angle of the first bend 15 is responsive to the angle of the slope 55 of the wafer 50. In one exemplary embodiment, the angle B is forced to become the angle of the slope 55 of the wafer 50. For example, if the slope 55 is Y degrees and a terminal 10 has a first bend 15 angle of B degrees, then the angle of the first bend 15 increases by X degrees after mating with the wafer 50, where X equals Y−B. Thus, the angle of the first bend 15 increases to B+X, or Y, degrees. Therefore, the wafer 50 changes the angle of the first bend 15 of the terminal 10 in the range between about 0 and Y degrees, and preferably about 5 degrees. It should be noted, however, that in accordance with the present invention, the angle of the first bend 15 of each of the terminals, while dictated by the slope 55 of the wafer 50, does not necessarily equal the slope 55 of the wafer 50. With the appropriate selection of the slope 55, a desired final angle of the first bend 15 can be attained.

Thus, because each terminal is forced by the wafer 50 to have the same first bend angle after the wafer is mated with the terminals, the wafer 50 repositions and supports the terminals 10 in coplanarity, regardless of the initial first bend angle of each of the terminals. For example, assuming a first terminal has an initial first bend angle of $B_1$ and a second terminal neighboring the first terminal has an initial first bend angle of $B_2$, and assuming B, does not equal $B_2$, after mating with the wafer having a slope of Y degrees, both terminals will have a first bend angle of Z (where Z may or may not be equal to Y), and thus be coplanar, although they had not initially been coplanar. The first bend angle of the first terminal will have increased by $X_1$ degrees ($X_1=Z-B_1$) and the first bend angle of the second terminal will have increased by $X_2$ degrees, ($X_2=Z-B_2$). Therefore, in accordance with the present invention, the subsequent addition of the wafer 50 to the connector assembly forces the terminals into the desired final assembled position. The wafer 50 makes the process of bending the terminals 10 into precise coplanarity less complex and more economically feasible.

Figure 2:
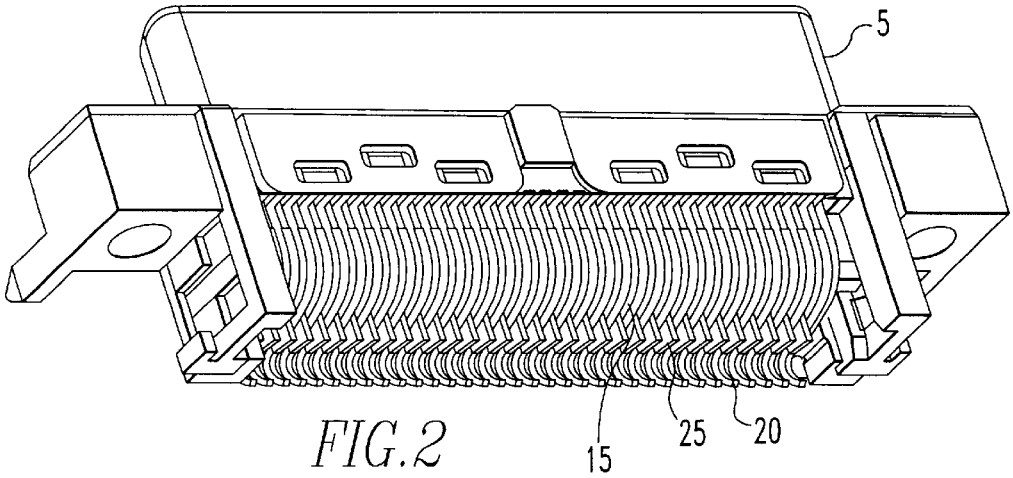
FIG. 2 is a front top perspective view of a row of exemplary terminals incorporated into a connector in accordance with the present invention.
Figure 3:
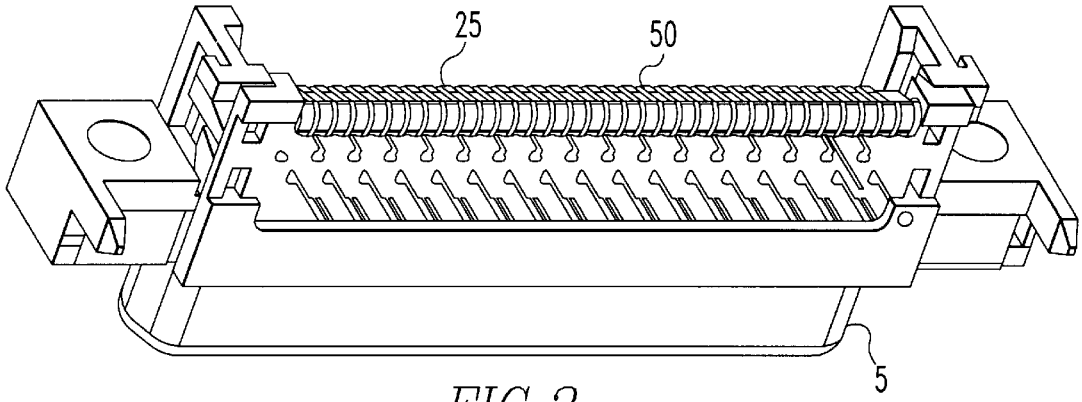
FIG. 3 is a front bottom perspective view of the connector of FIG. 2.
Figure 4:
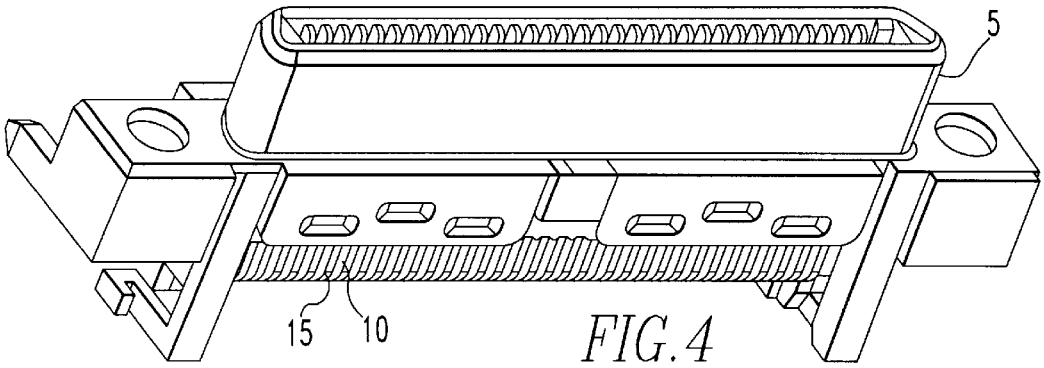
FIG. 4 is a rear top perspective view of the connector of FIG. 2.

FIG. 2 is a front top perspective view of a row of exemplary terminals incorporated into a conventional connector housing in accordance with the present invention. FIG. 3 is a front bottom perspective view of the connector of FIG. 2. FIG. 4 is a rear top perspective view of the connector of FIG. 2. FIGS. 2–4 contains elements similar to those described above with respect to FIG. 1. These elements are labeled identically and their description is omitted for brevity. The connector housing 5 has passages which contain the terminals 10 and insulate them from each other in parallel rows. Each passage snugly holds a terminal 10 and acts as an anchor point within the connector so that subsequent mating with the wafer 50 does not loosen or otherwise disturb the secure mounting of the terminal 10 in the connector housing 5.

In order to maintain coplanarity, each terminal preferably has a first bend angle less than about Y degrees, where Y is the angle of the slope 55 of the wafer 50, as described above with respect to FIGS. 1A–1C. As long as each terminal has an angle less than about Y degrees, and within about Y degrees of each other, coplanarity is achieved by the addition of the wafer.

After assembly of the connector, the solder tail of the second bend or heel 25 of each of the terminals 10 can be soldered or otherwise attached to a respective contact on a PCB to electrically and mechanically connect the connector to the PCB.

Figures 5A, 5B, 5C:
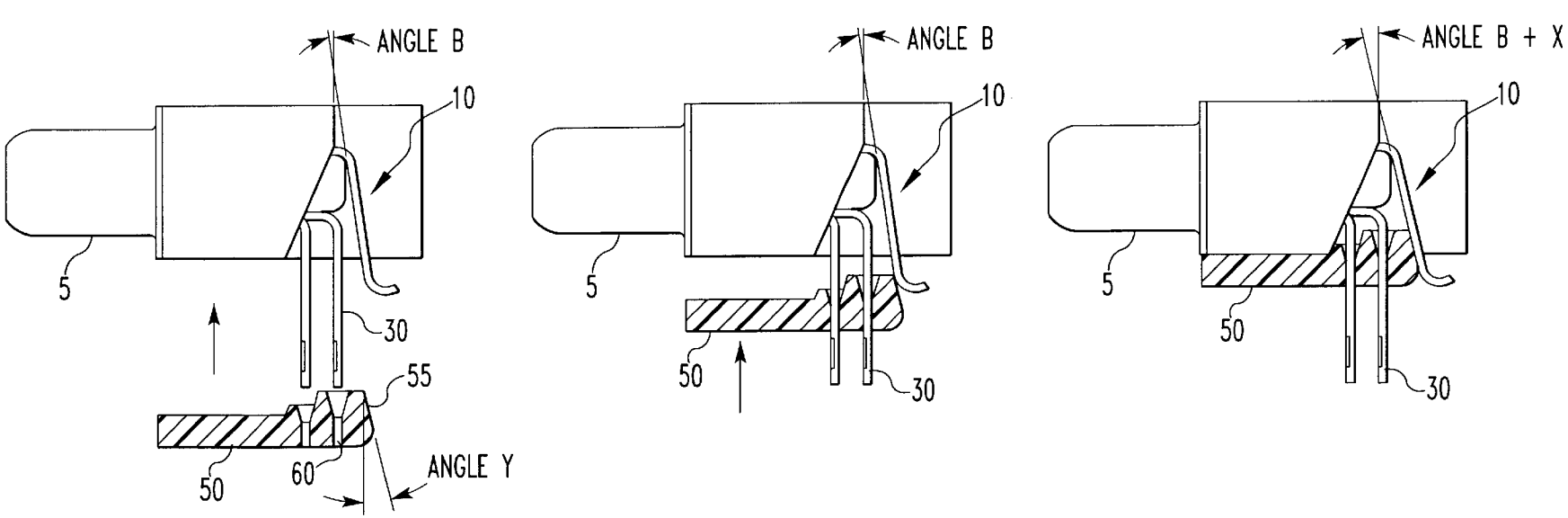
FIG. 5A is a cut-away side view of a further exemplary connector housing having a terminal in accordance with the present invention along with right angle terminals prior to mating with a wafer.
FIG. 5B is a cut-away side view of the exemplary connector housing of FIG. 5A as it is being mated with the wafer.
FIG. 5C is a cut-away side view of the exemplary connector housing of FIG. 5A after being mated with the wafer.

FIGS. 5A–5C are side views of a further exemplary connector housing having a terminal in accordance with the present invention as a wafer is being mated with the connector housing. This embodiment is similar to that described above with respect to FIGS. 1A–1C, and in this embodiment, right angle terminals 30 are provided in addition to the surface mount terminals 10. The right angle terminals 30 are conventional terminals and are used for contacting additional contacts in the PCB. The wafer 50 comprises apertures 60 corresponding to the terminals 30 so that the coplanarity of the terminals 10 is not affected during mating of the wafer 50 with the connector housing 5.

The present invention provides the advantages of lower manufacturing cost and better coplanarity for the terminals, thereby increasing yield, while reducing processing time.

Although illustrated and described herein with reference to certain specific embodiments, the present invention is nevertheless not intended to be limited to the details shown. Rather, various modifications may be made in the details within the scope and range of equivalents of the claims and without departing from the invention.

What is claimed:

1. An electrical connector assembly for mounting on a printed circuit board, comprising:

a housing having a plurality of passages;

a plurality of terminals, each terminal having a mating portion disposed in an associated one of said plurality of passages, a body extending from said mating portion at an initial angle, and a mounting portion extending from said body and arranged to engage an associated contact pad on said printed circuit board; and a wafer having a sloped end at an angle, said sloped end contacting said body of each of said plurality of terminals so that said plurality of terminals are bent from said initial angle to a predetermined angle, whereby each mounting portion of said plurality of terminals is coplanar.

2. The electrical connector assembly recited in claim 1, wherein said predetermined angle is responsive to said angle of said sloped end of said wafer.

3. The electrical connector assembly recited in claim 2, wherein said predetermined angle is substantially equal to said angle of said sloped end of said wafer.

4. The electrical connector assembly recited in claim 1, wherein said body is substantially linear.

5. The electrical connector assembly recited in claim 1, wherein said wafer comprises an insulating material.

6. The electrical connector assembly recited in claim 1, wherein said initial angle is not greater than said angle of said sloped end of said wafer.

7. The electrical connector assembly recited in claim 6, wherein said initial angle has a value in the range between about 5 and about 25 degrees, and said angle of said sloped end of said wafer has a value in the range between about 6 and about 45 degrees.

8. The electrical connector assembly recited in claim 7, wherein said initial angle has a value of about 10 degrees, and said angle of said sloped end of said wafer has a value of about 15 degrees.

9. The electrical connector assembly recited in claim 1, wherein said angle has a value in the range between about 6 and about 45 degrees.

10. The electrical connector assembly recited in claim 9, wherein said angle has a value of about 15 degrees.

11. An electrical connector assembly for mounting on a printed circuit board, comprising:

a housing having a plurality of passages;

a plurality of first terminals, each first terminal having a mating portion disposed in an associated one of said plurality of passages, a body extending from said mating portion at an initial angle, and a mounting portion extending from said body and arranged to engage an associated contact pad on said printed circuit board;

a plurality of second terminals, each second terminal having a mating portion disposed in an associated one of said plurality of passages and bent at approximately a right angle, and a body having a mounting portion arranged to engage an associated contact on said printed circuit board; and a wafer having a sloped end at an angle, said sloped end contacting said body of each of said plurality of first terminals so that said plurality of first terminals are bent from said initial angle to a predetermined angle, whereby each mounting portion of said plurality of first terminals is coplanar, and a plurality of apertures, each aperture corresponding to an associated one of said second terminals so that said body of said associated one of said second terminals passes through said aperture.

12. The electrical connector assembly recited in claim 11, wherein said predetermined angle is responsive to said angle of said sloped end of said wafer.

13. The electrical connector assembly recited in claim 12, wherein said predetermined angle is substantially equal to said angle of said sloped end of said wafer.

14. The electrical connector assembly recited in claim 11, wherein said body of said first terminal is substantially linear.

15. The electrical connector assembly recited in claim 11, wherein said wafer comprises an insulating material.

16. The electrical connector assembly recited in claim 11, wherein said initial angle is not greater than said angle of said sloped end of said wafer.

17. The electrical connector assembly recited in claim 16, wherein said initial angle has a value in the range between about 5 and about 25 degrees, and said angle of said sloped end of said wafer has a value in the range between about 6 and about 45 degrees.

18. The electrical connector assembly recited in claim 17, wherein said initial angle has a value of about 10 degrees, and said angle of said sloped end of said wafer has a value of about 15 degrees.

19. The electrical connector assembly recited in claim 11, wherein said angle has a value in the range between about 6 and about 45 degrees.

20. The electrical connector assembly recited in claim 19, wherein said angle has a value of about 15 degrees.

21. The electrical connector assembly recited in claim 1, wherein said sloped end is generally planar.

22. The electrical connector assembly recited in claim 11, wherein said sloped end is generally planar.

* * * * *